US006875050B2

(12) United States Patent
Ito et al.

(10) Patent No.: US 6,875,050 B2
(45) Date of Patent: Apr. 5, 2005

(54) INSIDE-DOOR-FUNCTION CONTROL UNIT

(75) Inventors: Tetsuo Ito, Anjyo (JP); Yasuaki Saito, Okazaki (JP)

(73) Assignee: Denso Corporation, Kariya (JP)

( * ) Notice: Subject to any disclaimer, the term of this patent is extended or adjusted under 35 U.S.C. 154(b) by 26 days.

(21) Appl. No.: 10/394,279

(22) Filed: Mar. 24, 2003

(65) Prior Publication Data

US 2003/0186574 A1 Oct. 2, 2003

(30) Foreign Application Priority Data

Mar. 29, 2002 (JP) ..... 2002-095522
Nov. 27, 2002 (JP) ..... 2002-343983

(51) Int. Cl.[7] ..... H01R 13/66
(52) U.S. Cl. ..... 439/533; 439/34
(58) Field of Search ..... 439/533, 422, 439/34, 502, 623, 498, 247–248, 364, 341, 362; 324/207.2, 207.25

(56) References Cited

U.S. PATENT DOCUMENTS 4,943,109 A * 7/1990 Skrbina et al. ..... 296/146.4
5,711,675 A * 1/1998 Nishitani et al. ..... 439/34
6,053,758 A * 4/2000 Kato et al. ..... 439/364
6,669,501 B2 * 12/2003 Serizawa et al. ..... 439/422
6,756,780 B2 * 6/2004 Hagio et al. ..... 324/207.25

FOREIGN PATENT DOCUMENTS

| | | |
|---|---|---|
| JP | A-9-195628 | 7/1997 |
| JP | A-11-50714 | 2/1999 |
| JP | A-2001-88552 | 4/2001 |

* cited by examiner

*Primary Examiner*—Gary Paumen
*Assistant Examiner*—Edwin A. Leon
(74) *Attorney, Agent, or Firm*—Posz & Bethards, PLC

(57) ABSTRACT

An actuator housing located between an external plate and internal plate of a door is electrically and mechanically connected with an ECU housing via water-proof elastic members, which are provided in an opening section of the internal plate and in an outer circumference of the opening section, by the first and the second connector. Further, a box nut provided in the actuator housing and a bracket provided in the ECU housing are connected with each other by a bolt while interposing the internal plate and the water-proof elastic sheet. Due to the foregoing, the mechanical strength of mounting the entire function control unit on the door can be enhanced. Accordingly, even when vibration or shock is given to the inside-door-function control unit while the door is being opened and closed or the vehicle is running, it is possible to prevent the inside-door-function control unit from being incompletely mounted on the door.

13 Claims, 10 Drawing Sheets

INSIDE-DOOR-FUNCTION CONTROL UNIT

BACKGROUND OF THE INVENTION

1. Field of the Invention

The present invention relates to an inside-door-function control unit used for a vehicle.

2. Description of the Related Art

There is provided a conventional power window control unit arranged inside a door in which a motor, to be used as an actuator for opening and closing a windshield, is arranged in a space surrounded by an external plate and internal plate of the door, and an ECU, which is a control circuit for controlling the actuator, and the actuator are connected with each other by a connector. This conventional power window control unit is disclosed in Japanese Unexamined Patent Publication No. 2001-88552. According to this prior art, when a water-proof section made of elastic material is provided so that the connector to connect the actuator with ECU can be covered with the water-proof section, water such as rain water existing in the space between the external and the internal plate can be prevented from entering ECU.

However, the actuator is connected with ECU and the internal plate of the door only by an electric connector and the water-proof section surrounding it. Accordingly, it is necessary to take countermeasures in order to solve the problem of rattling of the actuator and ECU which is caused by vibration in the case of opening and closing the door and also caused by vibration in the case where the vehicle is running. When the above rattle is caused in the actuator and ECU, performance of the electric connection of the connector is deteriorated, that is, the inside-door-function control unit can not be properly operated.

SUMMARY OF THE INVENTION

In view of the above problems, the present invention has been accomplished. It is an object of the present invention to provide an inside-door-function control unit capable of being properly mounted on the door and also capable of avoiding the occurrence of malfunction of the inside-door-function control unit even when vibration or shock is given to the control unit in the case where the vehicle is running.

In order to accomplish the above object, according to the first embodiment of the present invention, there is provided an inside-door-function control unit comprising: an actuator attached inside a door of a vehicle having an external and an internal plate; an ECU for controlling the actuator; a first connector for electrically connecting a housing of the actuator; a second connector for electrically connecting a housing of the ECU, the first and the second connector being directly connected with each other; and a connecting means for fixing and connecting the housing of the ECU and the housing of the actuator with each other via the internal plate.

According to the present invention, the actuator and the ECU composing the inside-door-function control unit are electrically, mechanically connected with each other by the direct connection of the first connector with the second connector, and the housing of the actuator and the housing of the ECU are fixed to each other via the internal plate by the connecting means. That is, the actuator and the ECU are respectively fixed onto the internal plate. Therefore, compared with a case in which the connection is accomplished only by the first and the second connector, the mechanical strength of mounting the entire inside-door-function control unit on the door can be enhanced. Accordingly, even when vibration or shock is given to the inside-door-function control unit while the door is being opened and closed or the vehicle is running, it is possible to prevent the inside-door-function control unit from being incompletely mounted on the door.

According to the second embodiment of the present invention, the connecting means is composed of a first member fixed to the housing of the actuator and a second member fixed to the housing of the ECU, a bolt is provided in one of the first and the second member, and the first and the second member are engaged with each other by a nut so that they can be fixed and connected.

According to the third embodiment of the present invention, the connecting means is composed of a first member fixed to the housing of the actuator and a second member fixed to the housing of the ECU, a clamp is provided in one of the first and the second member, a clamp receiver is provided in the other of the first and the second member, and the first and the second member are engaged with each other by the clamp and clamp receiver so that they can be fixed and connected.

According to the fourth embodiment of the present invention, there is provided an inside-door-function control unit comprising: an actuator attached inside a door of a vehicle having an external and an internal plate; an ECU for controlling the actuator; a first connector for electrically connecting a housing of the actuator; a second connector for electrically connecting a housing of the ECU, the first and the second connector being directly connected with each other; and a connecting means for fixing and connecting the internal plate with the housing of the ECU.

According to the present invention, the actuator and the ECU composing the inside-door-function control unit are electrically, mechanically connected with each other by the direct connection of the first connector with the second connector, and the housing of the ECU is fixed onto the internal plate by the connecting means. Therefore, compared with a case in which the connection is accomplished only by the first and the second connector, the mechanical strength of mounting the entire inside-door-function control unit on the door can be enhanced. Accordingly, even when vibration or shock is given to the inside-door-function control unit while the door is being opened and closed or the vehicle is running, it is possible to prevent the inside-door-function control unit from being incompletely mounted on the door.

In this connection, according to the fifth embodiment of the present invention, the connecting means is composed of a first member fixed to the internal plate and a second member fixed to the housing of the ECU, a bolt is provided in one of the first and the second member, and the first and the second member are engaged with each other by a nut so that they can be fixed and connected.

According to the sixth embodiment of the present invention, the connecting means is composed of a first member fixed to the internal plate and a second member fixed to the housing of the ECU, a clamp is provided in one of the first and the second member, a clamp receiver is provided in the other of the first and the second member, and the first and the second member are engaged with each other by the clamp and clamp receiver so that they can be fixed and connected.

According to the seventh embodiment of the present invention, the actuator and ECU are arranged on both sides of the internal plate, an opening is formed on the internal plate so that the first and the second connector can be electrically connected with each other, a water-proof elastic member is provided in an outer circumferential section of the opening on a face of the internal plate on the actuator side, and the housing of the actuator is tightly contacted with the internal plate via the water-proof elastic member.

According to this present invention, under the condition that the actuator and the ECU arranged on both sides of the internal plate are connected with each other by the first and the second connector via the opening formed on the internal plate, and the actuator and the ECU are tightly contacted with each other when a water-proof elastic member provided in the outer circumferential section of the opening is interposed between the actuator and the inner plate. Therefore, water is prevented from getting onto the ECU side from the actuator side, and the water-proof effect can be provided.

According to the eighth embodiment of the present invention, there is provided an inside-door-function control unit comprising: an actuator arranged on one side of an internal plate inside a door of a vehicle having the external and the internal plate; an ECU for controlling the actuator arranged on the other side of the internal plate; a first connector for electrically connecting a housing of the actuator; a second connector for electrically connecting a housing of the ECU, the first and the second connector being directly connected with each other; and a connecting means for fixing and connecting the housing of the ECU and the housing of the actuator with each other.

According to the present invention, the actuator and the ECU composing the inside-door-function control unit are electrically, mechanically connected with each other by the direct connection of the first connector with the second connector, and the housing of the actuator and the housing of the ECU are fixed to each other by the connecting means. Therefore, compared with a case in which the connection is accomplished only by the first and the second connector, the mechanical strength of mounting the actuator and the ECU can be enhanced. Accordingly, even when vibration or shock is given to the inside-door-function control unit while the door is being opened and closed or the vehicle is running, it is possible to prevent the inside-door-function control unit from being incompletely mounted on the door.

According to the ninth embodiment of the present invention, the connecting means can connect the housing of the ECU with the housing of the actuator via the internal plate. Due to the foregoing, when the ECU and the actuator are simultaneously fixed onto the internal plate, the occurrence of incomplete mounting can be prevented.

According to the tenth embodiment of the present invention, a connection hole for threading the connecting means is formed on the internal plate, a water-proof elastic member is provided in an outer circumferential section of the connection hole on the face of the internal plate on the actuator side, and the housing of the actuator is tightly contacted with the internal plate via the water-proof elastic member.

According to this invention, in the outer circumferential section of the connecting hole, which is formed on the internal plate, for threading the connecting means for connecting the ECU with the actuator, the water-proof elastic member is arranged so that it can be tightly contacted with the internal plate and the housing of the actuator. Therefore, it is possible to prevent water from getting into the connecting hole from the housing side of the actuator.

According to the eleventh embodiment, the connecting means is composed of a first member fixed to the housing of the actuator and a second member fixed to the housing of the ECU, a bolt is provided in one of the first and the second member, and the first and the second members are engaged with each other by a nut and directly fixed and connected. Alternatively, according to the twelfth embodiment, the connecting means is composed of a first member fixed to the housing of the actuator and a second member fixed to the housing of the ECU, a clamp is provided in one of the first and the second members, a clamp receiver is provided in the other, and the first and the second members are engaged with each other by the clamp and clamp receiver and directly fixed and connected.

According to the thirteenth embodiment, an opening for electrically connecting the first connector with the second connector is provided on the internal plate, a water-proof elastic member is provided in an outer circumferential section of the opening on the face of the internal plate on the actuator side, and the housing of the actuator is tightly contacted with the internal plate via the water-proof elastic member.

According to the present invention, the actuator and ECU are tightly contacted with each other when the water-proof elastic member arranged in the outer circumferential section of the opening, which is formed on the internal plate, is interposed between the actuator and the internal plate under the condition that the actuator and ECU are connected through the opening by the first and the second connector. Therefore, water is prevented from getting into the ECU side from the actuator side, which can provide water-proof effects.

The present invention may be more fully understood from the description of preferred embodiments of the invention set forth below, together with the accompanying drawings.

DESCRIPTION OF THE PREFERRED EMBODIMENTS

Figure 1:
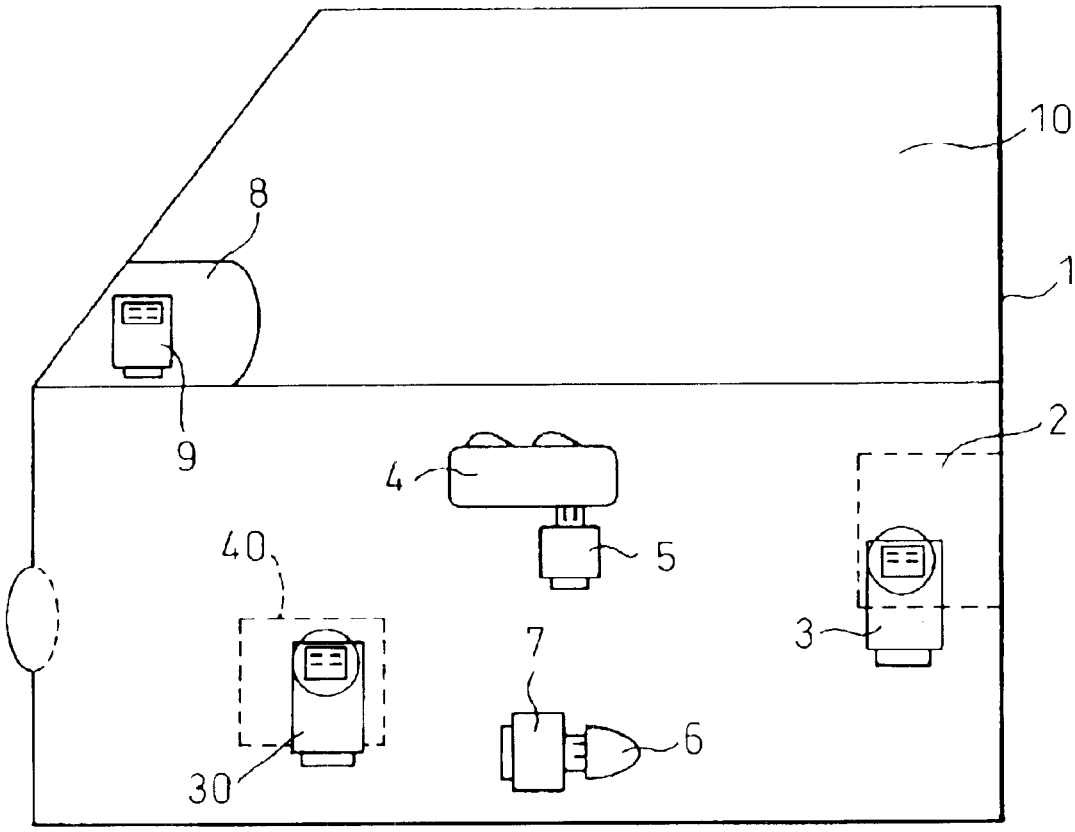
FIG. 1 is an arrangement view of the inside-door-function control unit of the embodiment of the present invention.

First of all, referring to the drawings, the first embodiment of the present invention will be explained below. FIG. 1 is a view showing a simplified state in which the inside-door-function control unit of the first embodiment of the present invention is arranged in the door 1. In FIG. 1, the actuator 40 for the power window, which will be referred to as PW hereinafter, to open and close the windshield 10 is arranged between the external plate 20 and the internal plate 21, and ECU 30 for PW to output a control signal is also arranged between the internal plate 21 and the door trim 25 as described later. The actuator 40 and ECU 30 are directly and electrically connected with each other by a connector.

The door lock actuator 2 to drive the door lock device and the door lock ECU 3 to control the door lock actuator 2, the power window switch 4, which will be referred to as PW hereinafter, to give a command for opening and closing the windshield 10 and ECU 5 for PW switch to generate a drive signal by switching operation, the door lamp 6 to be turned on and off when the door 1 is opened and closed and ECU 7 for the lamp to control the door lamp 6, ECU 9 for the mirror to control a tilting motion of the door mirror 8 and adjust a visible angle of the mirror and the actuator for the mirror, not shown, arranged in the mirror, not shown, are respectively, directly and electrically connected with each other by connectors.

In the first embodiment of the present invention, each actuator described above and each ECU to control the actuator are directly connected with each other by a connector arranged in the each housing so as to mechanically and electrically connect the actuator with ECU. Further, the housing of ECU is mechanically connected with the housing of the actuator or the internal plate of the door 1. Due to the above structure, even when vibration or shock is given to the inside-door-function control unit, no rattle is caused in the mounting structure. An example of the connection in which ECU 30 for PW and the actuator 40 for PW are connected with each other will be explained as follows.

Figure 2B:
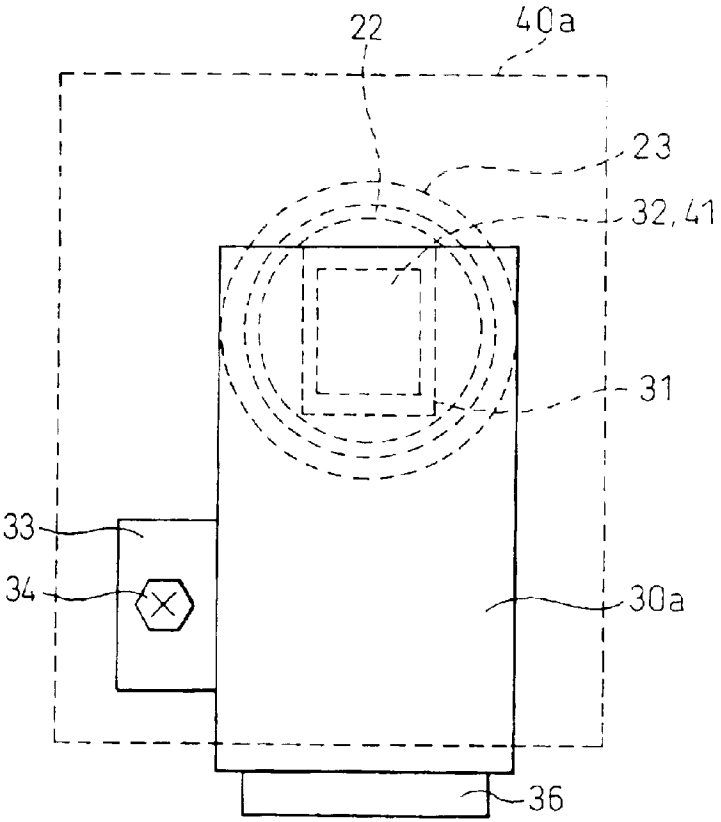
FIG. 2B is a plan view of the inside of the door of the first embodiment.
Figure 2A:
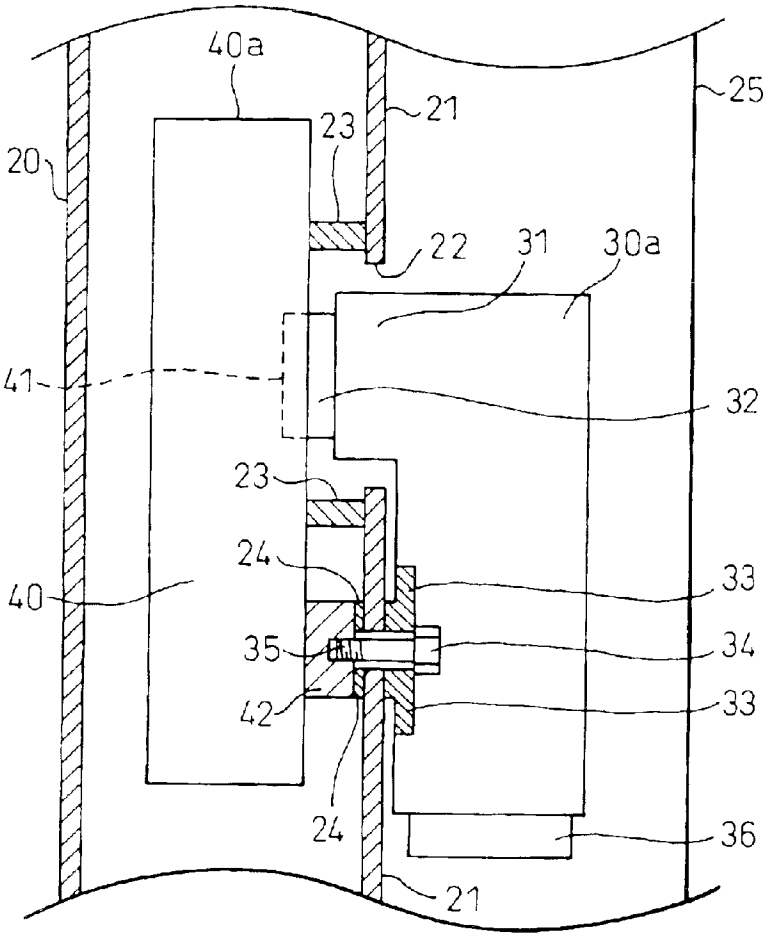
FIG. 2A is a sectional view of the inside of the door of the first embodiment.

FIG. 2A is a sectional view showing the inside of the door surrounded by the external plate 20, internal plate 21 and door trim 25 of the door 1. FIG. 2B is a plan view taken from the ECU 30 side. In this drawing, the door trim 25 is shown being simplified. In this connection, the windshield 10 driven by the actuator 40 for PW is omitted in FIGS. 2 to 7. In the following descriptions, the housing of ECU 30 and that of the actuator 40 are respectively represented by 30*a* and 40*a*.

The housing 40*a* of the actuator for PW is arranged between the external plate 20 and the internal plate 21. In the housing 40*a*, there is provided an electric connector 41 which is a first connector. On the other hand, on the internal plate 21, there is provided a circular opening 22 which is used for the electrical connection of ECU 30 with the actuator 40.

The cylindrical water-proof elastic member 23 is arranged in the outer circumferential section of the opening 22 on the internal plate 21 in such a manner that the cylindrical water-proof elastic member 23 surrounds the electric connector 41. In the case of assembling the actuator 40 to the door 1, the elastic member 23, which is bonded to the housing 40*a* of the actuator and the internal plate 21 by means of adhesive or pressure welding, is interposed between the housing 40*a* of the actuator and the internal plate 21, so that water can be prevented from getting into the door trim 25 from the housing 40*a* of the actuator and the opening 22.

The nut 42, which is a first member of the connection means, is joined to the housing 40*a* of the actuator by means of welding or adhesive. When this nut 42 is composed of a box nut, the water-proof property of the joining section can be enhanced.

On the other hand, in the housing 30*a* of ECU for PW, at an end portion of the protruding portion 31 protruding onto the opposite side of the internal plate 21 through the opening 22, there is provided an electric connector 32 which is the second connector. This second connector 32 is directly connected with the first connector 41 of the actuator 40. In the housing 30*a* of ECU, there is provided another electric connector 36. This electric connector 36 is connected with a connector not shown of ECU 5 for PW switch by wires. Alternatively this electric connector 36 is directly connected with a connector not shown of ECU 5 for PW switch, so that signals can be transmitted and received between the connectors.

The bracket 33 is fixed to the housing 30*a* of ECU for PW. In order to join the bracket 33 and the internal plate 21 to each other, the male screw section 35 of the bolt 34, which is the second member of the connecting means, is screwed to the nut 42. In this connection, the elastic sheet 24 is interposed between the nut 42 and the internal plate 21 and tightly contacted with the nut 42 and the internal plate 21 when the bolt 34 and the nut 42 are fastened to each other, so that the water-proof function can be accomplished.

As the first embodiment of the present invention is composed as described above, when the first and the second connector are directly connected with each other, the actuator 40 and ECU 30 are not only electrically but are also mechanically connected with each other. Further, by the box nut 42, which is the first member of the connecting means fixed to the housing 40*a* of the actuator, and also by the bolt 34, which is the second member, the actuator 40 and ECU 30 are connected with each other being interposed between the internal plate 21 and the bracket 33 fixed to the housing 30*a* of ECU. Therefore, ECU 30 and the actuator 40 can be connected with the door 1 with a higher mechanical strength. Accordingly, even when vibration or shock is given to the inside-door-function control unit when the door is opened and closed or the vehicle is running, it is possible to prevent the occurrence of incomplete mounting such as rattling.

Figure 3:
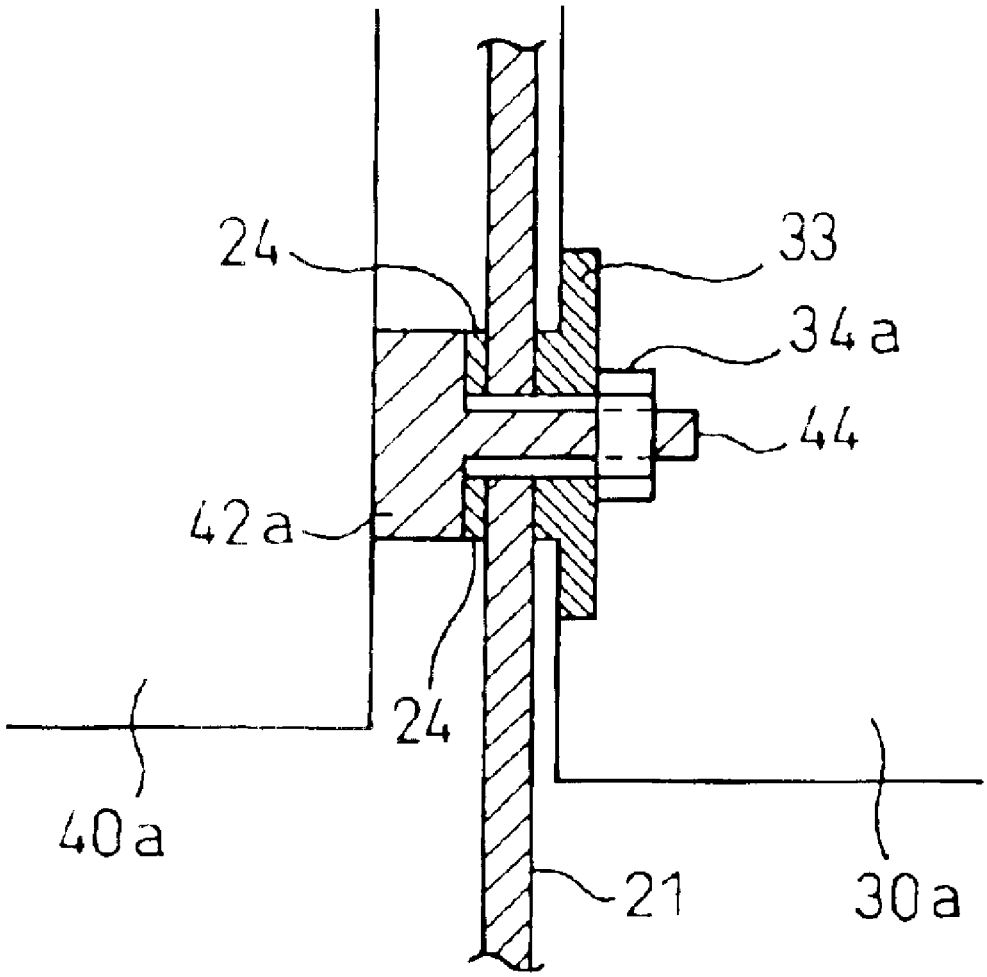
FIG. 3 is a view showing another example of the first embodiment.

In this connection, in the first embodiment described above, concerning the connecting means, the nut provided in the housing 40*a* of the actuator is the first member, and the bolt 34 screwed to the nut via the bracket 33 fixed to the housing 30*a* of ECU is the second member. However, the structure may be inverted. That is, as shown in FIG. 3, the bolt member 42*a* in which the male screw 44 is protruded from a block, the profile of which is the same as that of the nut 42, may be the first member. In this connection, like reference characters are used to indicate like parts in FIGS. 2 and 3, and the explanations are omitted here. In this case, the male screw section 44 of the bolt 42*a* is protruded from the internal plate 21 and the bracket 33 to the housing 30*a* of ECU and screwed to the nut 34*a* which is the second member so as to accomplish the connection.

Figure 4B:
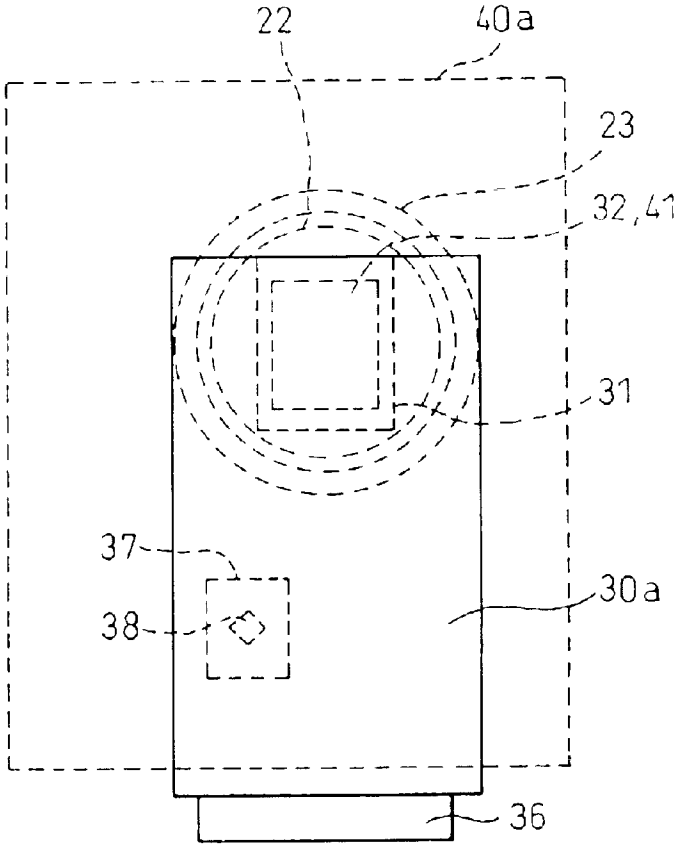
FIG. 4B is a plan view of the inside of the door of the second embodiment.
Figure 4A:
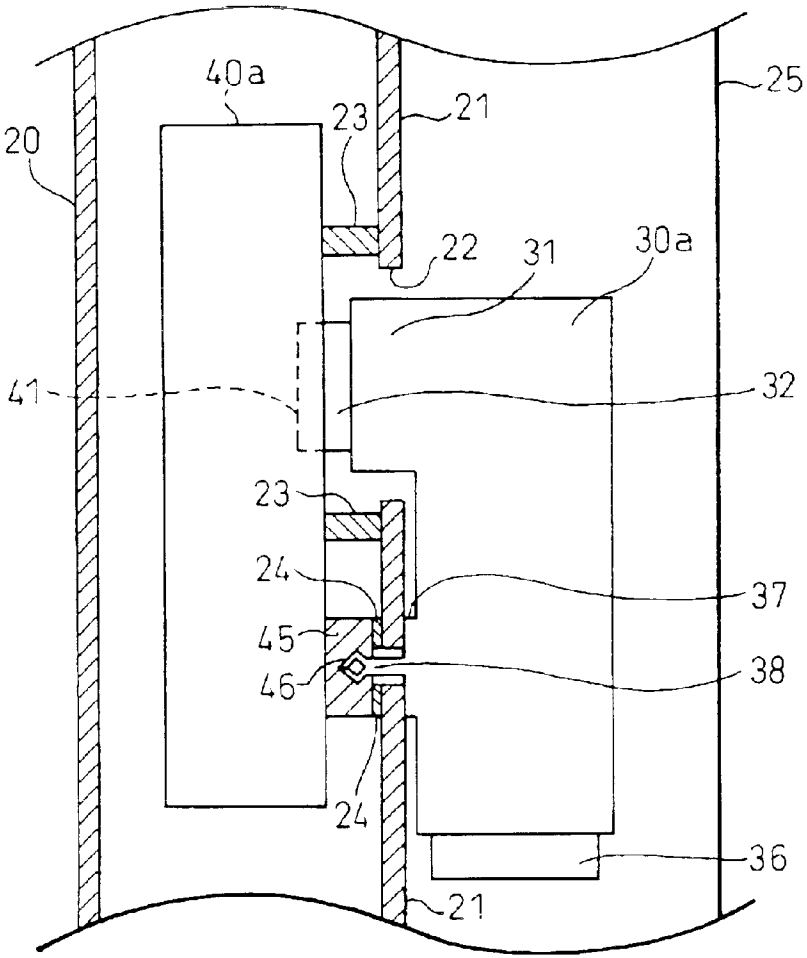
FIG. 4A is a sectional view of the inside of the door of the second embodiment.

Next, the second embodiment will be explained below. In the second embodiment, the connecting means is composed of a clamp and clamp receiver. FIG. 4A is a sectional view of the inside-door-function control unit of the second embodiment, and FIG. 4B is a plan view of the inside-door-function control unit of the second embodiment. In this connection, like reference characters are used to indicate like parts in the first and the second embodiment, and the explanations are omitted here.

In the connecting means of the second embodiment of the present invention, the clamp receiver 45 fixed to the housing 40*a* of the actuator is used as the first member. The clamp receiver 45 is a member, the height of which is appropriate, so that the clamp receiver 45 can be interposed between the internal plate 21, the water-proof elastic sheet 24 and the housing 40*a*. The clamp receiver 45 is joined to the housing 40*a* of the actuator by means of welding or adhesive. At the substantial center of the clamp receiver 45, there is provided a recess portion 46 for receiving the clamp.

On the other hand, in the housing 30*a* of ECU, there is provided a protruding portion 37. On the surface of the protruding portion 37, there is provided a clamp 38, which is the second member, being integrated with the protruding portion 37, so that the clamp 38 can be engaged with the recess portion 46 of the clamp receiver 45.

Accordingly, in the second embodiment of the present invention, in the same manner as that of the first embodiment, the actuator 40 and ECU 30 can be not only electrically, but also mechanically, connected with each other by the direct connection of the first connector with the second connector. Further, when the recess portion 46 of the clamp receiver 45, which is the first member of the connecting means, fixed to the housing 40*a* of the actuator is engaged with the clamp 38 integrally provided in the housing 30*a* of ECU which is the second member, the actuator 40 and ECU 30 are connected with each other while the internal plate 21 is interposed between them. Therefore, ECU 30 and the actuator 40 can be connected with the door 1 with a higher mechanical strength. Accordingly, even when vibration or shock is given to the inside-door-function control unit when the door is opened and closed or the vehicle is running, it is possible to prevent the occurrence of incomplete mounting such as rattling.

As the first and the second member are engaged with each other by the clamp, the assembling work can be made easy.

In this connection, in the same manner as that of the first embodiment, the water-proof effect between the actuator 40, internal plate 21 and ECU 30 can be provided by the cylindrical elastic member 23 and the elastic sheet 24.

Figure 5:
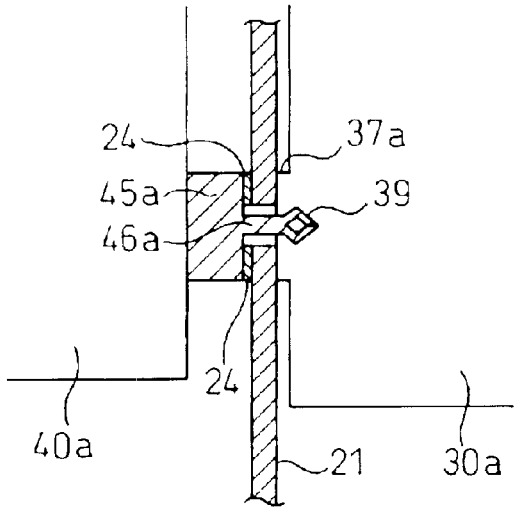
FIG. 5 is a view showing another example of the second embodiment.

In this connection, as shown in FIG. 5, the relation between the clamp and the clamp receiver may be inverted from that shown in the second embodiment. That is, in FIG. 5, the clamp member 45*a* in which the clamp 46*a* is protruded onto the ECU 30 side is used as the first member fixed to the housing 40*a* of the actuator. On the other hand, the clamp receiver 39 is formed in the protruding portion 37*a* provided in the housing 30*a* of ECU so that the clamp receiver 39 can be engaged with the clamp 46*a*, and this clamp receiver 39 is made to be the second member. Due to the above structure, the same effect as that of the second embodiment described above can be provided.

Figure 6:
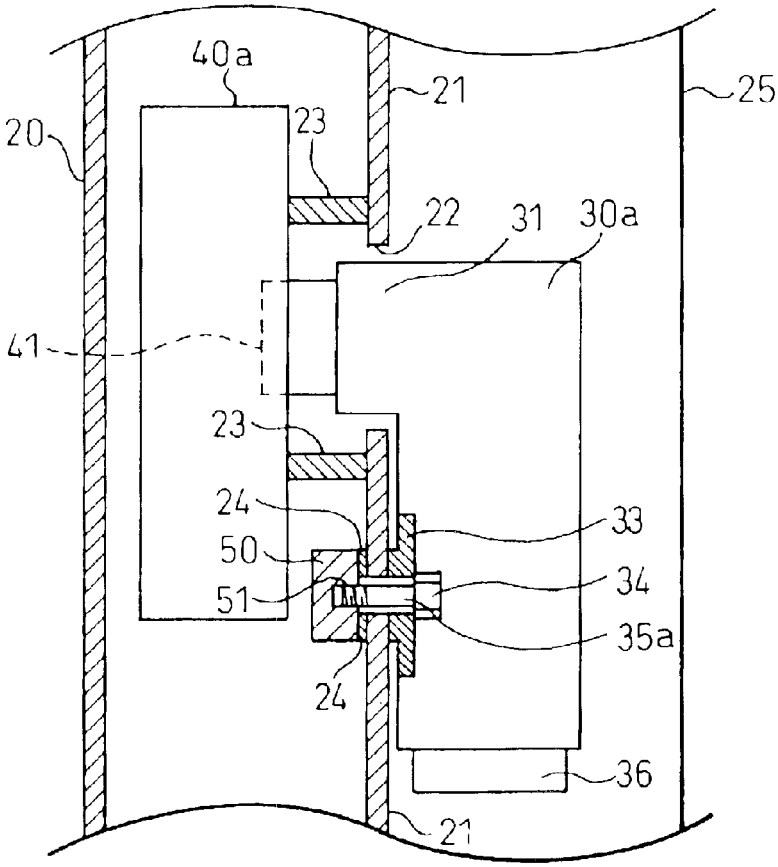
FIG. 6 is a sectional view of the inside of the door of the third embodiment.

Next, the third embodiment will be explained below. The third embodiment is different from the first and the second embodiment described before in the viewpoint that the first member, which is the connecting means, is provided not in the housing 40*a* of the actuator but on the internal plate 21. FIG. 6 is a sectional view of the third embodiment. In this connection, like reference characters are used to indicate like parts in each embodiment described before and the third embodiment, and the explanations are omitted here.

The connecting means of the third embodiment of the present invention is arranged being tightly contacted with the internal plate 21 when the box nut 50, which is the first member, is fastened to the bolt 34, which is the second means described later, via the internal plate 21 and the water-proof elastic sheet 24.

On the other hand, in the same manner as that of the first embodiment, the bracket 33 is fixed to the housing 30*a* of ECU. When the long axis section 35*a* of the bolt 34 is penetrated into the bracket 33 and the internal plate 21 and then the male screw 51 is screwed to the box nut 50, the bracket 33 is connected with the internal plate 21.

As described above, the actuator 40 is electrically, mechanically connected with ECU 30 by the first connector 41 and the second connector 32, and ECU 30 is connected by the box nut 50, which is the first member of the connecting means, and the bolt, which is the second member, via the internal plate 21 and the bracket 33 fixed to the housing 30*a* of ECU. Therefore, the mechanical strength of attaching the actuator 40 and ECU 30 to the door 1 can be enhanced. Accordingly, even when vibration or shock is given to the inside-door-function control unit when the door is opened and closed or the vehicle is running, it is possible to prevent the occurrence of incomplete mounting such as rattling.

In this connection, in the same manner as that of the first and the second embodiment, the water-proof effect between the actuator 40, internal plate 21 and ECU 30 can be provided by the cylindrical elastic member 23 and the elastic sheet 24.

In this connection, in the third embodiment described above, the connecting means is composed in such a manner that the box nut is the first member, and the bolt 34 screwed to the box nut via the internal plate 21 and the bracket 33, which is fixed to the housing 30*a* of ECU, is the second member. However, in the same manner as that of the variation (shown in FIG. 3) of the first embodiment, it is possible to adopt an inverse construction. That is, the male screw 44 protruding from the first member 42*a*, which is separate from the housing 40*a* of the actuator, is provided, and this male screw 44 penetrates the internal plate 21 and the bracket 33, and then the nut 34*a* is screwed to and connected with the male screw 44 protruding onto the ECU 30 side.

Figure 7:
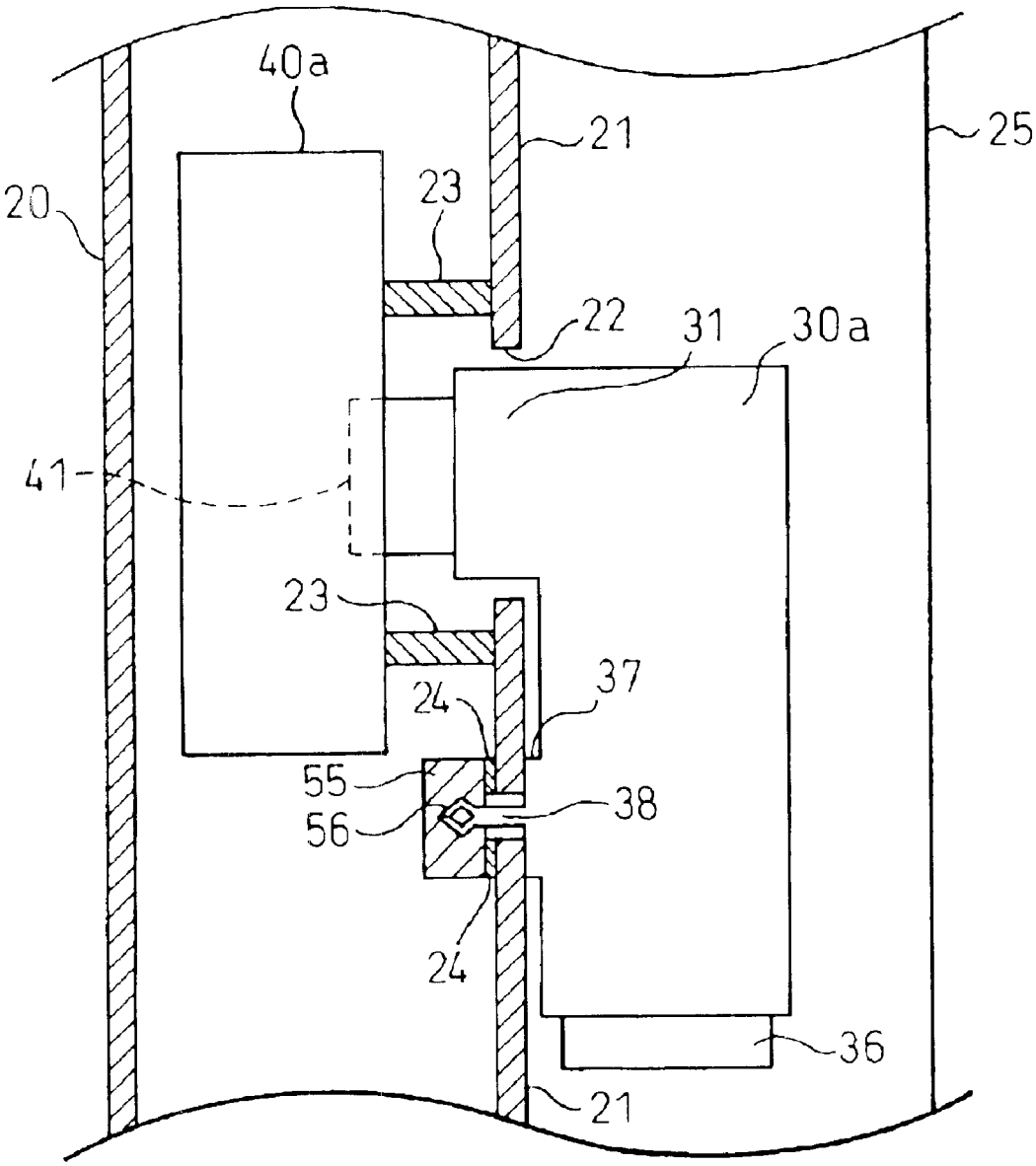
FIG. 7 is a sectional view of the inside of the door of the fourth embodiment.

Next, the fourth embodiment will be explained below. In the fourth embodiment, the connecting means is composed of a clamp and clamp receiver instead of a bolt and nut composing the connecting means of the third embodiment. FIG. 7 is a sectional view of the fourth embodiment. In this connection, like reference characters are used to indicate like parts in the third and the fourth embodiment, and the explanations are omitted here.

The connecting means of the fourth embodiment is arranged so that it can be tightly contacted with the internal plate 21 by the connection of the clamp receiver 55, which is the first member, with the clamp 38, which will be described later, via the internal plate 21 and the water-proof elastic sheet 24.

On the other hand, in the same manner as that of the second embodiment, in the housing 30*a* of ECU, there is provided a protruding portion 37. On the surface of the protruding portion 37, there is provided a clamp 38 being integrated with the protruding portion, so that the clamp 38 can be engaged with the recess portion 55 of the clamp receiver 56.

Accordingly, in the fourth embodiment of the present invention, in the same manner as that of the third embodiment, the actuator 40 and ECU 30 can be electrically, mechanically connected with each other by the direct connection of the first connector 41 with the second connector 32. Further, the clamp receiver 55, which is the first member of the connecting means, and the clamp 38, which is the second member, are connected with each other while the internal plate 21 is interposed between them. Therefore, the mechanical strength of attaching the actuator 40 and ECU 30 to the door 1 can be enhanced. Accordingly, even when vibration or shock is given to the inside-door-function control unit when the door is opened and closed or the vehicle is running, it is possible to prevent the occurrence of incomplete mounting such as rattling.

In this connection, in the same manner as that of the third embodiment, the water-proof effect between the actuator 40, internal plate 21 and ECU 30 can be provided by the cylindrical elastic member 23 and the elastic sheet 24.

In this connection, in the fourth embodiment described above, the connecting means is composed in such a manner that the clamp receiver 55 is the first member, and the clamp 38 engaging with the clamp receiver 55 via the internal plate 21 is the second member. However, in the same manner as that of the variation (shown in FIG. 5) of the second embodiment described before, it is possible to adopt an inverse construction, that is, the clamp 46*a* is protruded from the first member 45*a* which is separate from the housing 40*a* of the actuator. This clamp 46*a* is made to penetrate the internal plate 21, and the clamp 46*a* protruding onto the ECU 30 side is engaged with the clamp receiver 39 arranged in the protruding portion 37*a* of the ECU housing 30*a*.

Next, the fifth embodiment will be explained below. In the same manner as that of the first embodiment described above, in the fifth embodiment, the connecting means is composed of a bolt and nut, and the first member is arranged in the housing 40*a* of the actuator and the second member is arranged in the housing 30*a* of ECU. A different point of the fifth embodiment from the first embodiment is that the first and the second member are directly connected with each other without interposing the internal plate 21.

Figure 8B:
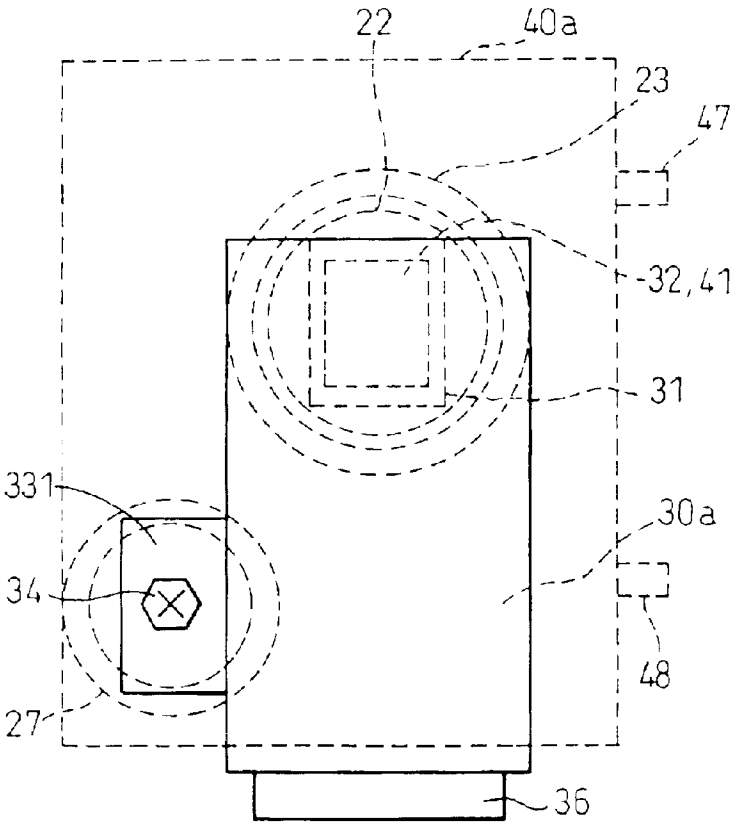
FIG. 8B is a plan view of the inside of the door of the fifth embodiment.
Figure 8A:
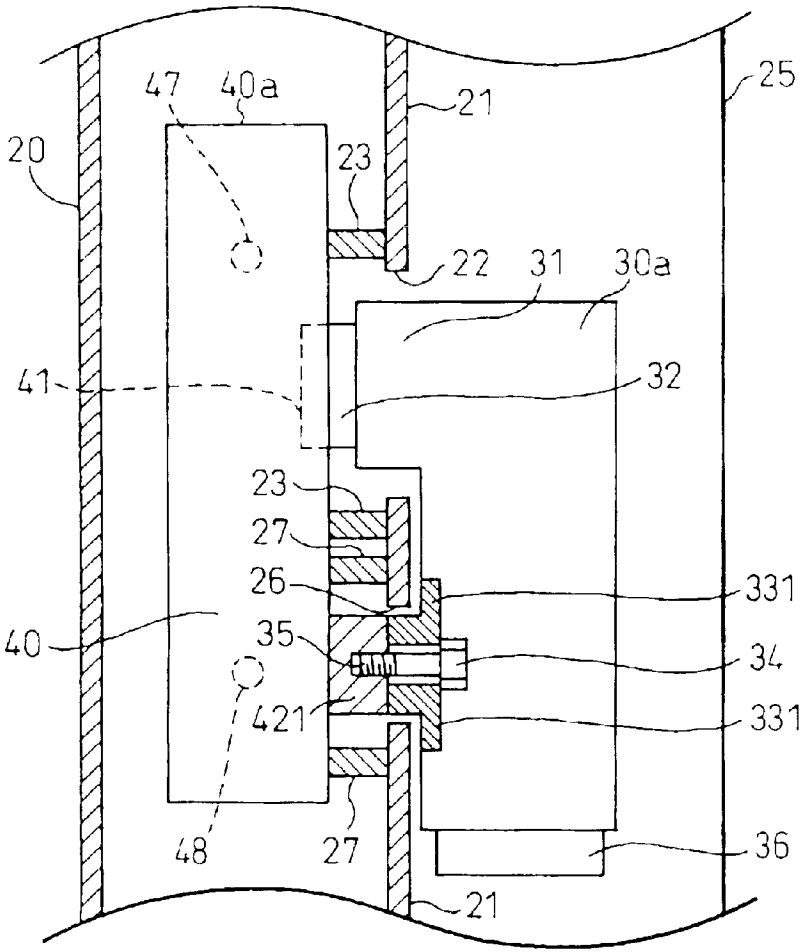
FIG. 8A is a sectional view of the inside of the door of the fifth embodiment.

FIG. 8A is a sectional view of the inside-door-function control unit of the fifth embodiment, and FIG. 8B is a plan view of the inside-door-function control unit of the fifth embodiment. In this connection, like reference characters are used to indicate like parts in the first to the fifth embodiment, and the explanations are omitted here.

In this fifth embodiment, the housing 40*a* of the actuator is fixed with the bolts 47, 48 at an appropriate position (not shown) in the space surrounded by the external plate 20 and the internal plate 21 of the door 1.

In the connecting means, the nut 421 fixed to the housing 40*a* of the actuator is the first member. The bracket 331, which is fixed to the housing 30*a* of ECU, and the bolt 34, which is screwed to the nut 421 via this bracket 331, are the second member.

On the other hand, on the internal plate 21, there is provided a circular hole 26 for connection through which the connecting means threads. Further, the bracket 331, which is connected with the bolt 34 of the connecting means, and the nut 421 penetrate this circular hole 26 for connection. Due to the foregoing, the housing 30*a* of ECU and the housing 40*a* of the actuator can be positively and mechanically connected with each other.

In this case, the cylindrical water-proof elastic member 27 is interposed between the internal plate 21 and the housing 40*a* of the actuator being tightly contacted by means of adhesive or pressure welding so that the cylindrical water-proof elastic member 27 can surround the nut 421 and the bracket 331 at the outer circumferential section of the hole 26 for connection. Due to the above structure, it is possible to prevent water from getting into the door trim 25 from the hole 26 for connection.

As described above, in the fifth embodiment of the present invention, the actuator 40 and ECU 30, which are fixed to the external plate 20 or the internal plate 21 of the door 1, are not only electrically but also mechanically connected with each other by the direct connection of the first connector with the second connector. Further, the actuator 40 and ECU 30 are directly connected with each other by the nut 421, which is the first member of the connecting means fixed to the housing 40*a* of the actuator 40*a*, the bolt 34, which is the second member, and the bracket 331. Therefore, ECU 30 and the actuator 40 can be connected with the door 1 by a sufficiently high mechanical strength.

Accordingly, even when vibration or shock is given to the inside-door-function control unit while the door is being opened and closed or the vehicle is running, it is possible to prevent the inside-door-function control unit from being incompletely mounted on the door.

In the outer circumferential sections of the opening 22 and the hole 26 for connection provided on the internal plate 21, the water-proof elastic members 23, 27 are respectively arranged being tightly contacted with between the internal plate 21 and the housing 40*a* of the actuator. This structure can provide a water-proof effect between the actuator 40 and ECU 30.

In this connection, in the fifth embodiment described above, in the connecting means, the nut 421 fixed to the housing 40*a* of the actuator is the first member. The bracket 331, which is fixed to the housing 30*a* of ECU, and the bolt 34, which is screwed to the nut 421 via this bracket 331, are the second member. However, the structure is not limited to the above specific embodiment but an inverse structure may be adopted.

Figure 9:
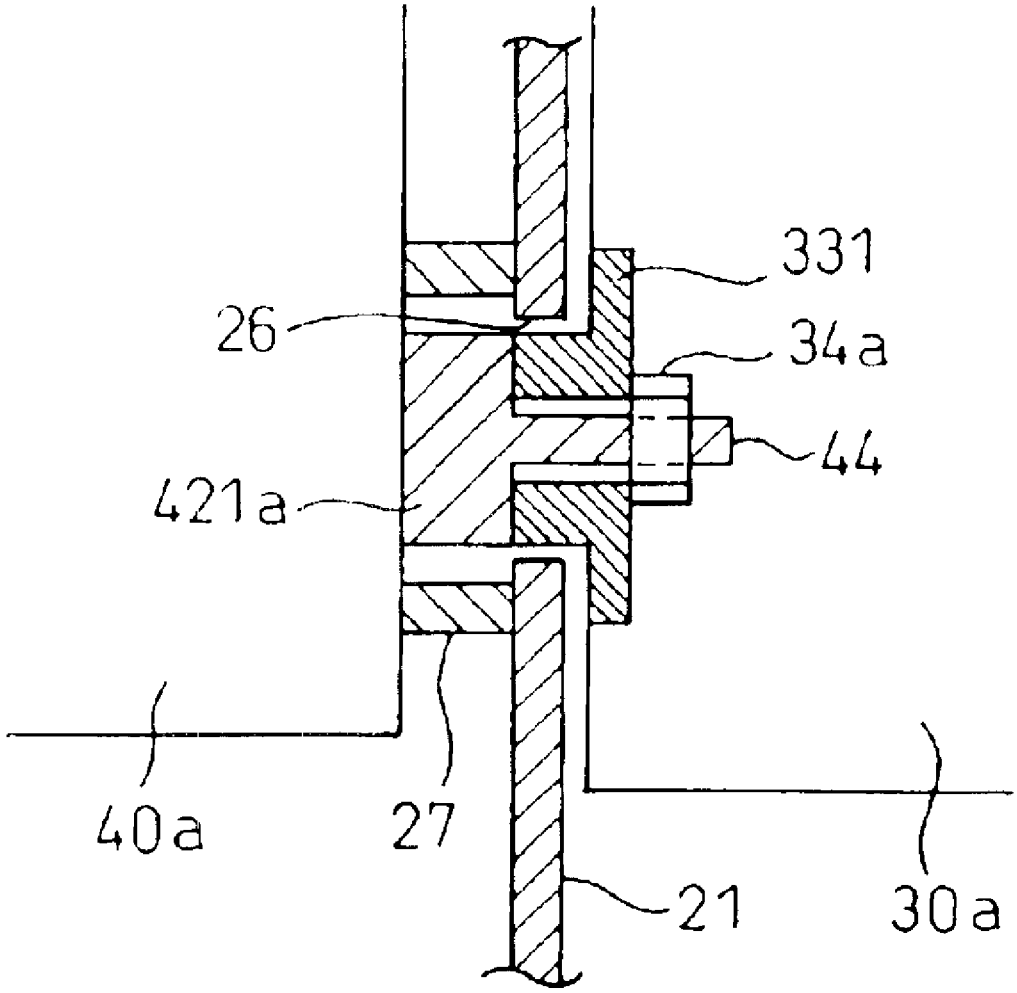
FIG. 9 is a view showing another example of the fifth embodiment.

That is, as shown in FIG. 9, the bolt member 421*a*, which is formed in such a manner that the male screw 44 is protruded from a block, the profile of which is the same as that of the above nut 421, may be the first member. In this connection, like reference characters are used to indicate like parts in FIGS. 8 and 9, and the explanations are omitted here. In this case, the male screw section 44 of the bolt member 421*a* can be protruded to the housing 30*a* of ECU from the internal plate 21 and the bracket 331 and connected being screwed to the nut 34*a* which is the second member.

Figure 10B:
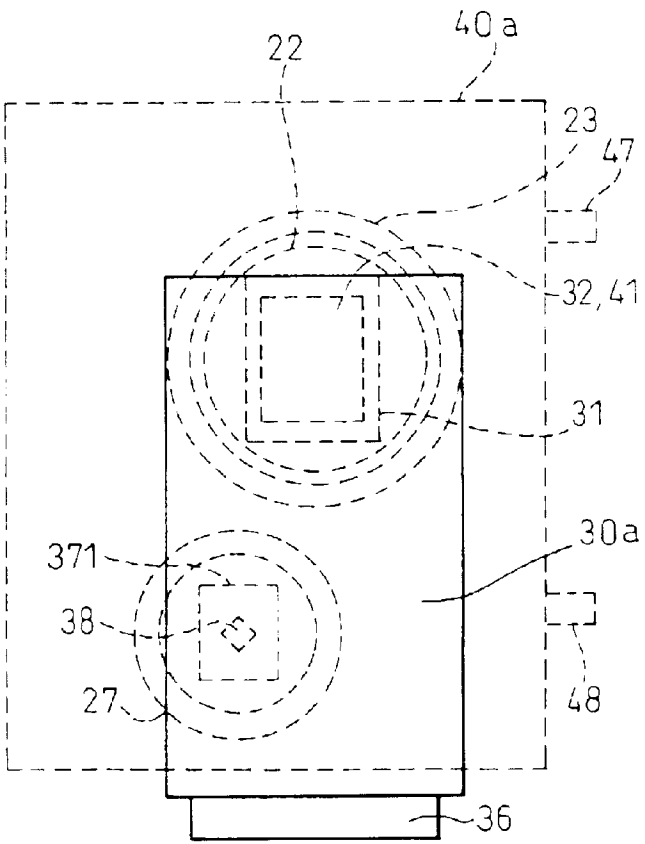
FIG. 10B is a plan view of the inside of the door of the sixth embodiment.
Figure 10A:
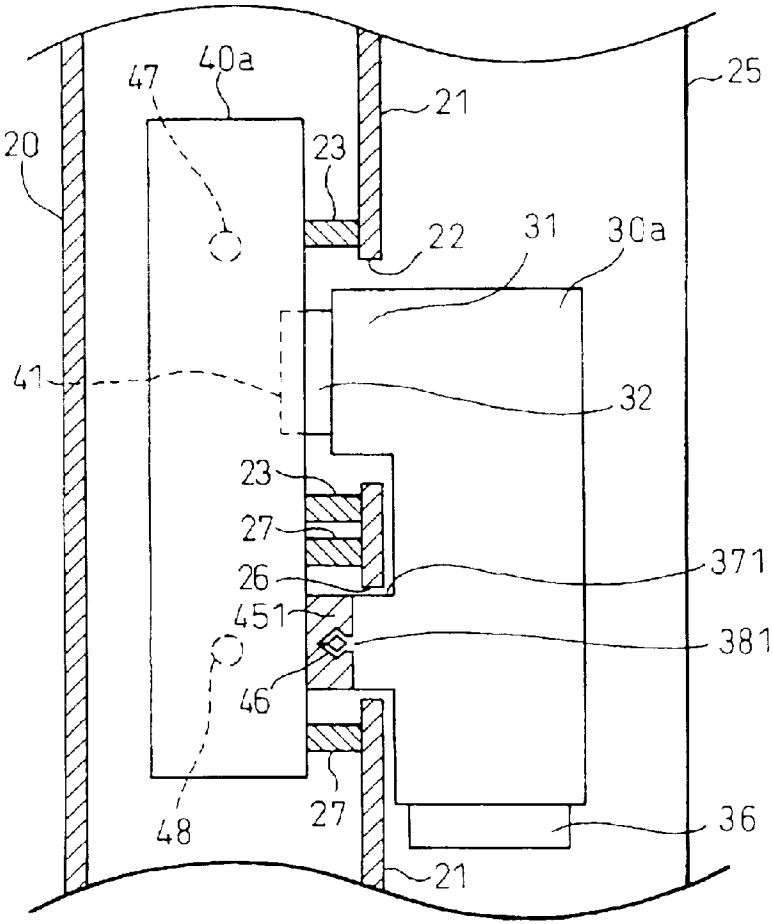
FIG. 10A is a sectional view of the inside of the door of the sixth embodiment.

Finally, the sixth embodiment will be explained below. In the sixth embodiment, the connecting means is composed of a clamp and clamp receiver instead of the bolt and nut used in the fifth embodiment described before. FIG. 10A is a sectional view of the inside-door-function control unit of the sixth embodiment, and FIG. 10B is a plan view of the inside-door-function control unit of the sixth embodiment. In this connection, like reference characters are used to indicate like parts in the first to the sixth embodiment.

In this sixth embodiment, in the same manner as that of the fifth embodiment, the housing 40*a* of the actuator is fixed with the bolts 47, 48 at an appropriate position (not shown) in the space surrounded by the external plate 20 and the internal plate 21 of the door 1.

In the connecting means, the clamp receiver 451 fixed to the housing 40*a* of the actuator is the first member. The clamp 381 integrally provided in the protruding portion 371 of the housing 30*a* of ECU is the second member.

On the other hand, on the internal plate 21, there is provided a circular hole 26, for connection, through which the connecting means threads. Further, the clamp receiver 451, which is the connecting means, and the protruding portion 371, in which the clamp 381 connecting with the recess portion 46 of the clamp receiver 451 is provided, penetrate this circular hole 26 for connection. Due to the foregoing, the housing 30*a* of ECU and the housing 40*a* of the actuator can be positively and mechanically connected with each other.

In this case, the cylindrical water-proof elastic member 27 is interposed between the internal plate 21 and the housing 40*a* of the actuator being tightly contacted by means of adhesive so that the cylindrical water-proof elastic member 27 can surround the clamp receiver 451 and the protruding section 371 at the outer circumferential section of the hole 26 for connection. Due to the above structure, it is possible to prevent water from getting into the door trim 25 from the hole 26 for connection.

As described above, in the sixth embodiment of the present invention, in the same manner as that of the fifth embodiment, the actuator 40 and ECU 30, which are fixed to the external plate 20 or the internal plate 21 of the door 1, are not only electrically, but also mechanically, connected with each other by the direct connection of the first connector with the second connector. Further, the actuator 40 and ECU 30 are directly connected with each other when the recess portion 46 of the clamp receiver 451, which is the first member of the connecting means fixed to the housing 40*a* of the actuator 40*a*, and the clamp 381, which is integrally provided in the housing 30*a* of ECU which is the second member, are engaged with each other. Therefore, ECU 30 and the actuator 40 can be connected with the door 1 by a sufficiently high mechanical strength.

Accordingly, even when vibration or shock is given to the inside-door-function control unit while the door is being opened and closed or the vehicle is running, it is possible to prevent the inside-door-function control unit from being incompletely mounted on the door.

Since the first and the second member are engaged with each other by the clamp, the assembling work can be easily performed.

In the outer circumferential sections of the opening 22 and the hole 26 for connection provided on the internal plate 21, the water-proof elastic members 23, 27 are respectively arranged by being tightly contacted between the internal plate 21 and the housing 40*a* of the actuator. Therefore, this structure can provide an water-proof effect between the actuator 40 and ECU 30.

Figure 11:
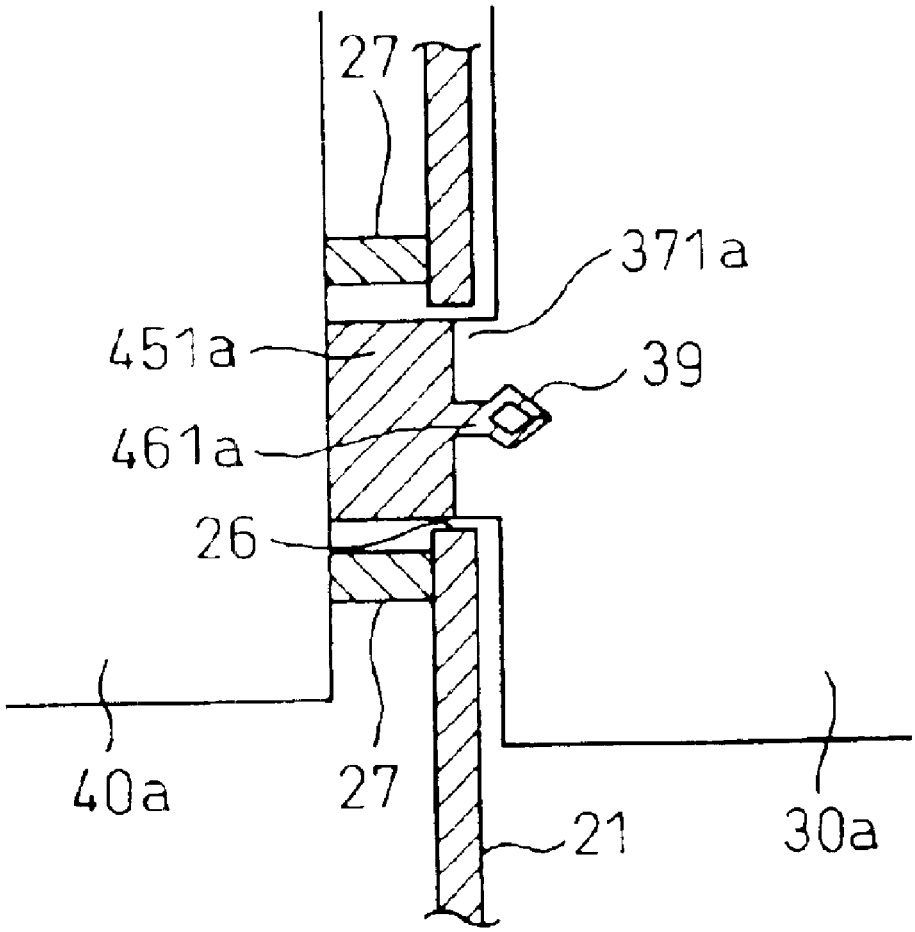
FIG. 11 is a view showing another example of the sixth embodiment.

In this connection, a relation between the clamp and the clamp receiver may be changed as shown in FIG. 11 so that the relation can be inverted from that of the sixth embodiment. That is, in FIG. 11, the clamp member 451*a* in which the clamp 461*a* is protruded onto the ECU 30 side is used as the first member which is fixed to the housing 40*a* of the actuator. On the other hand, the clamp receiver 39 is formed in the protruding section 371*a* provided in the housing 30*a* of ECU so that the clamp receiver 39 can be engaged with the clamp 461*a*. This clamp receiver 39 is made to be the second member. Due to the above structure, it is possible to provide the same effect as that of the sixth embodiment described before.

While the invention has been described by reference to specific embodiments chosen for purposes of illustration, it should be apparent that numerous modifications could be made thereto, by those skilled in the art, without departing from the basic concept and scope of the invention.

What is claimed is:

1. An inside-door-function control unit comprising: an actuator attached inside a door of a vehicle having an external and an internal plate and a door trim; an ECU for controlling the actuator; a first connector for electrically connecting a housing of the actuator; a second connector for electrically connecting a housing of the ECU, the first and the second connector being directly connected with each other; and a connecting means for fixing and connecting the housing of the ECU and the housing of the actuator with each other via the internal plate, said housing of the actuator is disposed between said external plate and said internal plate, while the housing of the ECU is disposed between said internal plate and said door trim, said housing of the actuator and said housing of the ECU face each other via said internal plate, said internal plate is provided with openings having such a dimension that said first connector and said second connector can enter the openings respectively, said first connector and said second connector are connected via said opening, and said connecting means is independently provided at a certain distance from a point where said connectors are connected.

2. An inside-door-function control unit according to claim 1, wherein the connecting means is composed of a first member fixed to the housing of the actuator and a second member fixed to the housing of the ECU, a bolt is provided in one of the first and the second member, and the first and the second member are engaged with each other by a nut so that they can be fixed and connected.

3. An inside-door-function control unit according to claim 1, wherein the connecting means is composed of a first member fixed to the housing of the actuator and a second member fixed to the housing of the ECU, a clamp is provided in one of the first and the second member, a clamp receiver is provided in the other of the first and the second member, and the first and the second member are engaged with each other by the clamp and clamp receiver so that they can be fixed and connected.

4. An inside-door-function control unit according to claim 1, wherein the actuator and ECU are arranged on both sides of the internal plate, an opening is formed on the internal plate so that the first and the second connector can be electrically connected with each other, a water-proof elastic member is provided in an outer circumferential section of the opening on a face of the internal plate on the actuator side, and the housing of the actuator is tightly contacted with the internal plate via the water-proof elastic member.

5. An inside-door-function control unit comprising: an actuator attached inside a door of a vehicle having an external and an internal plate and a door trim; an ECU for controlling the actuator; a first connector for electrically connecting a housing of the actuator; a second connector for electrically connecting a housing of the ECU, the first and the second connector being directly connected with each other; and a connecting means for fixing and connecting the internal plate with the housing of the ECU, said housing of the actuator is disposed between said external plate and said internal plate, while the housing of the ECU is disposed between said internal plate and said door trim, said housing of the actuator and said housing of the ECU face each other via said internal plate, said internal plate is provided with openings having such a dimension that said first connector and said second connector can enter the openings respectively, said first connector and said second connector are connected via said opening, and said connecting means is independently provided at a certain distance from a point where said connectors are connected.

6. An inside-door-function control unit according to claim 5, wherein the connecting means is composed of a first member fixed to the internal plate and a second member fixed to the housing of the ECU, a bolt is provided in one of the first and the second member, and the first and the second member are engaged with each other by a nut so that they can be fixed and connected.

7. An inside-door-function control unit according to claim 5, wherein the connecting means is composed of a first member fixed to the internal plate and a second member fixed to the housing of the ECU, a clamp is provided in one of the first and the second member, a clamp receiver is provided in the other of the first and the second member, and the first and the second member are engaged with each other by the clamp and clamp receiver so that they can be fixed and connected.

8. An inside-door-function control unit comprising: an actuator arranged on one side of an internal plate inside a door of a vehicle having the external and the internal plate; an ECU for controlling the actuator arranged on the other side of the internal plate; a first connector for electrically connecting a housing of the actuator and a door trim; a second connector for electrically connecting a housing of the ECU, the first and the second connector being directly connected with each other; and a connecting means for fixing and connecting the housing of the ECU and the housing of the actuator with each other, said housing of the actuator is disposed between said external plate and said internal plate, while the housing of the ECU is disposed between said internal plate and said door trim, said housing of the actuator and said housing of the ECU face each other via said internal plate, said internal plate is provided with openings having such a dimension that said first connector and said second connector can enter the openings respectively, said first connector and said second connector are connected via said opening, and said connecting means is independently provided at a certain distance from a point where said connectors are connected.

9. An inside-door-function control unit according to claim 8, wherein the connecting means fixes and connects the housing of the ECU with the housing of the actuator via the internal plate.

10. An inside-door-function control unit according to claim 8, wherein an opening for electrically connecting the first connector with the second connector is provided on the internal plate, a water-proof elastic member is provided in an outer circumferential section of the opening on the face of the internal plate on the actuator side, and the housing of the actuator is tightly contacted with the internal plate via the water-proof elastic member.

11. An inside-door-function control unit according to claim 8, wherein a connection hole for threading the connecting means is formed on the internal plate, a water-proof elastic member is provided in an outer circumferential section of the connection hole on the face of the internal plate on the actuator side, and the housing of the actuator is tightly contacted with the internal plate via the water-proof elastic member.

12. An inside-door-function control unit according to claim 11, wherein the connecting means is composed of a first member fixed to the housing of the actuator and a second member fixed top the housing of the ECU, a bolt is provided in one of the first and the second member, and the first and the second member are engaged with each other by a nut and directly fixed and connected.

13. An inside-door-function control unit according to claim 11, wherein the connecting means is composed of a first member fixed to the housing of the actuator and a second member fixed to the housing of the ECU, a clamp is provided in one of the first and the second member, a clamp receiver is provided in the other, and the first and the second member are engaged with each other by the clamp and clamp receiver and directly fixed and connected.

* * * * *